US005190796A

United States Patent [19]

Iacovangelo

[11] Patent Number: 5,190,796

[45] Date of Patent: Mar. 2, 1993

[54] IMPROVED METHOD OF APPLYING METAL COATINGS ON DIAMOND AND ARTICLES MADE THEREFROM

[75] Inventor: Charles D. Iacovangelo, Schenectady, N.Y.

[73] Assignee: General Electric Company, Schenectady, N.Y.

[21] Appl. No.: 722,575

[22] Filed: Jun. 27, 1991

[51] Int. Cl.[5] ..... C23C 26/00

[52] U.S. Cl. ..... 427/304; 427/305; 427/306; 427/437; 427/443.1; 427/380; 205/158; 205/187

[58] Field of Search ..... 427/437, 443.1, 304, 427/305, 306, 380; 205/187, 158

[56] References Cited

U.S. PATENT DOCUMENTS

| | | | |
|---|---|---|---|
| Re. 33,767 | 12/1991 | Christini | 427/443.1 |
| 2,411,867 | 12/1946 | Brenner . | |
| 2,694,019 | 11/1954 | Gutzeit . | |
| 3,547,692 | 12/1970 | Hill | 427/305 |
| 3,650,714 | 3/1972 | Farkas . | |
| 3,674,516 | 7/1972 | Kovac | 427/443.1 |
| 3,819,497 | 6/1974 | Grunwald | 427/437 |
| 3,924,031 | 12/1975 | Nicholas et al. . | |
| 4,167,416 | 9/1979 | Zolla . | |
| 4,327,126 | 4/1982 | Ogden | 205/187 |
| 4,381,227 | 4/1983 | Narcus . | |
| 4,399,167 | 8/1983 | Pipkin et al. . | |
| 4,435,189 | 3/1984 | Bovenkerk | 427/304 |
| 4,555,315 | 11/1985 | Barbieri | 205/296 |
| 4,557,808 | 12/1985 | Strunck | 205/187 |
| 4,591,363 | 5/1986 | Silverman . | |
| 4,994,329 | 2/1991 | Kaimasu | 205/187 |

FOREIGN PATENT DOCUMENTS

| | | | |
|---|---|---|---|
| 5227874 | 9/1974 | Japan . | |
| 1049130 | 4/1976 | Japan | 427/304 |
| 54-21926 | 2/1979 | Japan . | |
| 60-75582 | 4/1985 | Japan . | |

*Primary Examiner*—Shrive Beck
*Assistant Examiner*—Vi Duong Dang
*Attorney, Agent, or Firm*—William H. Pittman

[57] ABSTRACT

A method of improving adhesion of a nickel alloy to the surfaces of diamond particles and articles made therefrom. Diamond particles are electrolessly nickel plating with the nickel alloy formed with a transitional metal, such as molybdenum. Electrolessly plated particles are then gradually heated at a steady rate from room temperature to a desired heat treatment temperature in a non-oxidizing atmosphere formed by argon containing 10% hydrogen. Exemplary articles made by the aforementioned process include a grinding wheel having uniformly dispersed abrasive diamond particles having the Ni/Mo alloy coat thereon.

16 Claims, No Drawings

IMPROVED METHOD OF APPLYING METAL COATINGS ON DIAMOND AND ARTICLES MADE THEREFROM

FIELD OF THE INVENTION

The present invention is generally related to a method of applying metal coating on diamond. More particularly, the invention relates to coating electroless metal alloys on diamond.

BACKGROUND OF THE INVENTION

Diamond is an allotrope of carbon exhibiting a crystallographic network comprising exclusively of covalently bonded, aliphatic $sp^3$ hybridized carbon atoms arranged tetrahedrally with a uniform distance of 1.545 Å between atoms. Diamond is extremely hard having a Mohs hardness of 10. It exhibits four times the thermal conductivity of copper and it is electrically insulating. Its hardness and thermal properties are but two of the characteristics that make diamond useful in a variety of industrial components.

Abrasive particles, such as diamond particles, have been extensively used for cutting, grinding, lapping and polishing in metal removing industries as well as in medical fields such as dentistry and surgery. Abrasive particles are used in abrasive tools such as grinding and dressing wheels, crowns and single point tools. Considerable amount of research has gone into improving the bonding properties of diamond to the matrices of these tools since poor bonding at the diamond/matrix interface leads to dislodgement of the diamond particle from the matrix during the abrading operation. As a result of this research, it is known in the art that the metal coating of abrasive particles improves the retention of such particles in the matrices of various abrasive tools, such as resin bonded wheels. In particular it is known that the retention of diamond particles is improved with nickel coating. By applying a rough textured nickel coat having jagged edges, the metal coated particles provide mechanical interlocking means to retain the abrasive particles during the abrading operation. The metal coat also provides means for evenly transfering heat generated along the surfaces of the abrasive particles during the abrading action. However metal layers have poor adhesion to diamond.

It is also known in the art that the retention of diamonds in the abrasive tools is further improved by providing the particles with multiple layers of metals, such as molybdenum, titanium, niobium, chromium, zirconium, copper and nickel.

The metal coating of the particles may be achieved by a variety of methods depending on the nature of the metal coating. The metal coating may be applied under high temperature, by well known processes, such as chemical vapor deposition, molten salt deposition and powder agglomeration coating. The main drawback of such techniques is that the high process temperatures can significantly degrade the abrasive particles. The aforementioned problem of degradation may be somewhat obviated by electrolytically, electrolessly or vacuum depositing the metal coating on abrasive particles, however the problem of poor adhesion to diamond still remains.

The present invention is directed to improving adhesion of metal coats to the surfaces of diamond particles.

In addition to aforementioned diamond particles, the present invention is also directed to an article that combines the features of a heat exchanger and a printed circuit board. Printed circuit boards have become the dominant vehicle for mounting and interconnecting electronic components used for manufacturing a desired electronic circuit that generates significant degree of heat. The printed circuit board usually comprises a sheet of a dielectric substrate constructed from a chemical vapor deposited diamond film. The substrate is provided with a pattern of thin metal layer which functions as a conductive path on one or both sides. The paths or "tracks" are usually formed of a conductive material such as copper, palladium, nickel or gold. The traces collectively define all of the electrical connections between components on the board, and are routed between the locations on the board.

Diamond films are suitable for printed circuit board substrates because of their high electrical resistance, heat resistance, dimensional stability, and exceptional heat conductivity. However, diamond substrates are not easily provided with a strongly adherent metal trace. The printed circuit, i.e., the plated metal conductive path, can be damaged or separated from the substrate during the subsequent manufacturing steps or during use of the circuit board.

Additionally metal coated diamond films have also been used as heat sinks for electrical components that generate significant amount of heat.

STATEMENT OF THE INVENTION

The present invention is directed to a method of improving adhesion of a nickel alloy coat to a surface of a diamond article comprising the steps of contacting said article for an effective time with an electroless plating bath for plating said surface of said article to a desired thickness, said bath comprising a compound of nickel and a compound of a transitional metal selected from the group consisting of molybdenum, titanium, niobium and chromium, gradually heating the electrolessly plated article in a non-oxidizing atmosphere from a first temperature to a desired heat treatment temperature at a predetermined rate, and maintaining the electrolessly plated article at the desired heat treatment temperature until a desired degree of adhesion between the surface and the metal alloy coat is attained.

Typically a nickel/molybdenum alloy coat is applied by the aforementioned method to diamond particles. Such particles are then uniformly dispersed and embedded in a resinous matrix of a grinding wheel to improve its abrasion efficiency.

Other advantages of the invention will become apparent upon reading the following detailed description and appended claims.

DETAILED DESCRIPTION OF THE PREFERRED EMBODIMENT

The present invention is directed to improving adhesion of metal coatings on diamond surfaces. The diamond surfaces are electrolessly plated with a nickel alloy containing a transition metal to improve the wettability of the diamond surfaces as well as improve formation of a chemical bond between the nickel alloy and diamond.

Generally an adhesive bond between the metal layer and the surface of the underlying substrate is established by interfacial molecular contact between the metal layer and the surface. The interfacial molecular contact is proportional to the wettability of the surface. The wettability of the surface is defined in terms of the angle of contact of a liquid droplet on a surface. A wettable surface will have acute angle (less than 90°) of contact whereas a non-wettable surface will have obtuse angle (more than 90°) of contact.

The steps of the invention provide for chemically modifying a surface of an article of diamond, such as diamond particles, for improving adhesion of a metal layer thereon. In one of its embodiments, the process of this invention provides for sequentially contacting the surface with the solutions disclosed hereinafter.

The diamond surface is catalytically activated to permit electroless metal deposition. The catalytically activated surface is then electrolessly plated with a metal layer of a desired thickness. In subsequent steps the electrolessly plated surface may be electrolytically plated (electroplated) or electrolessly plated with another layer of a metal similar to the one underneath or a different one. The steps are normally interposed with rinsing steps.

The term "surface" or "diamond surface" means a surface of a diamond substrate used in an article such as abrasive particles embedded in a grinding wheel, a printed circuit board substrate or a heat sink for electrical circuits. Typically the abrasive particles made from diamond have a mesh size between 320 and 30. However it is apparent to those skilled in the art that the present invention is also suitable for mesh sizes bigger or smaller than those mentioned above.

If necessary the diamond surface may be initially degreased with a degreasing agent such as a detergent, a suitable organic solvent or a dilute acid. Typical surface cleaners suitable for the diamond surface are solvents such as Freon® TF 1,1,2-trichlorotrifluoroethane, dilute nitric acid or dilute hydrochloric acid. However environmentally safe cleaners such as Shipley Acid Cleaner 1118, Micro manufactured by International Products Inc., Trenton, N.J., or alcoholic solutions of amines such as SP-734 manufactured by Chemical Solvents Inc., Cleveland, Ohio are often preferred.

As used hereinafter, the term "degreased" means a diamond substrate having its surface free of oil, finger prints or extraneous material.

As used hereinafter "effective time, temperature and concentration" relate to a period of duration, degrees of temperature and concentration respectively required to achieve a sufficient level of the metal deposition necessary to produce a desired result on the surface and those skilled in the art will readily realize that by manipulating the concentrations and the temperatures of the various aforementioned reagents used in the present invention, the time of contact may be optimized for particular processing conditions.

It is often useful to begin the activation of the surface by treatment with an additive which aids in absorption of the plating catalyst. Such additives are well-known in the art. Exemplary aids to catalyst absorption include Shipley Cuposit® 1175A Cleaner-Conditioner, a mix of ethanolamine and triethanolamine manufactured by the Shipley Company, and Metex® 9420, a product of the MacDermid Corporation.

Immersion in about 0.1% to about 5% by volume of either of these agents in water for about 1 minute to about 10 minutes at a temperature of from about 40° C. to about 80° C. is usually sufficient. Preferably a Shipley Cuposit® 1175A bath maintained at about 55° C. and having a concentration level recommended by the manufacturer, of about 2.5% by volume, is used.

Activation of the surface for plating purposes can be achieved by well known methods of the art. For example, the substrate may be contacted with an acid solution of a precious metal, such as palladium chloride in hydrochloric acid, for a period of time sufficient to cause catalytic activation of the surface.

One illustrative activation technique involves immersing the surface in a solution of MacDermid® D34C Pd, a product of the MacDermid Corporation. This solution provides a palladium/tin plating catalyst. A water rinse generally follows the activation step.

After surface activation and rinsing, electroless plating of a nickel alloy coat can be undertaken. Illustrative electroless baths of the invention comprise a conventional electroless nickel/phosphorus plating bath, such as AK 1000® sold by Allied Kelite Corporation, mixed with a compound of a transitional element. The pH of the bath is adjusted from about 8.5 to about 10, preferably to about 9 by adding an alkali metal hydroxide. NaOH is preferred. Illustrative nickel alloys used to form the metal coat include transition elements, such as molybdenum, tungsten, titanium, niobium or chromium. Molybdenum is preferred. A preferred electroless bath comprises a conventional nickel/phosphorus bath, such as AK 1000®, mixed with sodium molybdate at a concentration of about 0.001M to about 0.100M, preferably at a concentration of about 0.01M to about 0.02M. Another suitable electroless bath comprises a conventional nickel/phosphorus bath, such as AK 1000®, mixed with sodium tungstate at a concentration of about 0.01M to about 0.5M, preferably at a concentration of about 0.1M to about 0.3M. Electroless baths are well-known in the art and are generally described in the *Kirk-Othmer Encyclopedia of Chemical Technology*, 3rd Edition, Volume 8, the contents of which are incorporated herein by reference.

The selection of a particular bath or electroless plating process is not critical to the present invention. The contents of the bath and the particular plating parameters, e.g., temperature, pH, and immersion time, will of course depend on the particular metal alloy being deposited thereon. Immersion times, bath temperatures, and other operating parameters can be determined and controlled according to manufacturers' suggestions. Typically the bath may be agitated by ultrasonic or stirring means during the plating of the diamond particles to prevent bridging between the individual particles. A fluidized bed may be also employed to prevent the aforementioned bridging action. Those having ordinary skill in the plating art will be able to determine the most appropriate plating procedure for a particular situation.

The metal coated diamond surface is then subjected to a heat treatment after electroless deposition of the metal alloy. During the heat treatment the temperature is gradually increased at a steady predetermined rate from a first temperature to a heat treatment temperature for preventing balling of the metal layer. The term "balling" is defined as a delamination of a metal coat from an underlying surface wherein the metal coat curls away from the surface to form a ball-like shape. The temperature is raised at the rate of less than 20° C. per minute, preferably at the rate of about 10° C. per minute. The first temperature is typically room temperature of about 24° C. The heat treatment is conducted in a non-oxidizing atmosphere containing an inert gas mixed with about 5% to about 10% by volume of hydrogen. The inert gas may be selected from the noble gases of Group XVIII of the periodic chart. Argon is preferred. It is understood that nitrogen is not a suitable inert gas because its tendency to form nitride with the transitional elements, such as molybdenum. Oven heating of the entire article, i.e., substrate with metal thereon, is sufficient, although any heating method is suitable. Typically, this heat treatment is carried out at a heat treatment temperature ranging from about 500° C. to about 1100° C., preferably at about 800° C. to about 1000° C. for about 25 minutes to about 120 minutes, with higher temperatures within the above range generally compensating for shorter duration, and vice versa. Although the mechanism is not fully understood, the heat treatment appears to improve formation of the chemical bond between the diamond surface and the metal layer.

If another layer of metal is to be applied on the electrolessly metal coated surface, e.g., by electroplating, the above-described heat treatment can in some instances be omitted if the aforementioned heat treatment is employed after the final plating step, as described below. However, preferred embodiments include the heat treatment prior to deposition of the additional metal layers.

Though electroless plating is the preferred application method for the second metal layer, electroplating may be also used. The substrate is usually cleaned prior to immersion in the electroplating bath. The cleaning can be performed by rinsing the substrate with a dilute solution of a strong acid, such as 10% by volume hydrochloric acid in water.

Electroplating baths are well-known in the art and are described, for example, in U.S. Pat. No. 4,555,315, incorporated herein by reference, although the particular electroplating bath used is not critical to the present invention. The choice of course depends in part on the particular metal being deposited. Suitable metals include nickel, copper, cobalt, silver, palladium, platinum and gold. Furthermore, those skilled in the art appreciate that the particular bath contents will depend upon some of the factors considered for the electroless deposition of metal described above. Typically, the electroplating bath for copper is operated at a temperature ranging from about 16° C. to about 38° C., with a cathode current density in the range of about 1 amperes per square foot (ASF) to about 80 ASF. A description of baths for plating copper or various other metals is given in the *Kirk-Othmer* reference described above, in Vol. 8, beginning on page 826. Baths used to apply a layer typically include an aqueous acidic copper electrolyte such as those of the acidic copper sulfate or acidic copper fluoroborate type; halide ions, such as chloride and/or bromide ions; and various other components well-known in the art. The thickness of this second metal layer will of course depend upon the desired end use of the metal-coated substrate.

The metal layer applied from a electrolytic solution without chemical additives, such as levelling agents and brighteners, usually has a nodular and somewhat rough appearance. Such surface texture is desired on diamond particles used in abrasive tools because such a rough surface texture allows diamond particles to increase their retention to the matrix of the abrasive tool. While such a surface may be suitable for the aforementioned use, a smooth, level surface is desired for others, such as a printed circuit board.

A smooth surface can be achieved by the deposition of a second electrolytic layer, which contains chemical additives, on top of the first rough electrolytic layer. The bath used to apply this layer is sometimes referred to herein as an "additive" bath. However if smooth surface is desired, it is preferable to use the additive bath for the first electrolytic layer.

An etching agent is often used prior to the deposition of this second electrolytic layer. A typical example of the etching agent is a dilute solution of a strong acid, such as hydrochloric acid in water at a concentration of 50% by volume. The substrate is immersed in the aforementioned etching agent for about 10 seconds to about 120 seconds. A deionized water rinse step usually follows the etching step. The substrate is now ready for further plating. The electrolytic bath for the second electrolytic layer can be one of the conventional baths known in the art.

These baths contain effective amounts of brighteners and levelling agents, as well as other additives, all of which are known in the art and are described, for example, in *Decorating Plastics*, edited by James M. Margolis, Hanser Publishers, 1986; by J. D. Reid and A. P. David in *Plating and Surface Finishing*, January 1987, pp. 66–70; in *Modern Electroplating*, edited by Frederick A. Lowenheim, Third Edition, John Wiley and Sons, Inc.; and in the United Kingdom Patent application of D. Morrissey et al, GB2123036A.

Examples of other chemical additives are stress relievers, depolarizers, plating suppressors, and wetting agents, as well as agents used for hardening, grain refining, reducing "trees", and limiting current density. Thus, the term "chemical additives" as used herein is meant to include any of the above-mentioned agents.

After deposition of the second electrolytic layer, the surface is rinsed again with water and may be provided with a second heat treatment for further enhancing adhesion of the metal layers to the substrate. A typical heat treatment for this step involves temperatures ranging from about 100° C. to about 500° C. for a time period ranging from about 5 minutes to about 20 hours.

The result of the second electrolytic deposition can be a smooth, bright metal layer characterized by a high level of adhesion to the diamond surface.

In the preferred embodiments, an article prepared by the method of this invention usually has a first electrolessly applied metal coat of about 0.25 micron to about 3 microns thickness; a second electrolessly applied metal layer of about 5 microns; and a third, if so desired, electrolessly applied metal layer of about 5 microns thickness. However it should be noted that the present invention contemplates multiple layers of different metals and it should not be construed that the invention is restricted to just three or less metal layers.

An article prepared by the method of this invention comprises a diamond surface, having a metal layer alloyed with a transitional metal disposed on such surface. The metal layer comprises an electrolessly applied first metal coat on the diamond surface. Additional secondary metal layers may be electrolessly or electrolytically applied on top of the first metal coat until a desired thickness is attained. The present invention contemplates various combinations of metal layers such as a single nickel/molybdenum alloy layer, a primary nickel/molybdenum alloy layer followed by a secondary nickel/phosphorus layer or a primary nickel/molybdenum alloy layer followed by a secondary copper layer and a tertiary gold layer.

An article of manufacture of the preferred embodiment is an article such as metal coated diamond abrasive particles embedded in a resinous matrix of an abrasive tool, such as a grinding wheel having particle surfaces electrolessly metal coated with a first nickel/molybdenum alloy coat thereon by the process of the present invention. A second metal layer preferably of nickel/phosphorus may be disposed on top of the first metal coat, the second layer being electrolessly or electrolytically applied on the first layer. As stated earlier, the second layer is preferably deposited by electroless metal deposition. The combined thickness of the metal layers is adjusted to a desired thickness sufficient to withstand the abrading action.

Other articles of manufacture are a metal coated diamond substrate used as a heat sink for electrical components or a printed circuit board having a chemically vapor deposited diamond film as a substrate. The substrate is provided with conductive metal tracks deposited on the substrate to form electrical interconnections between electrical components disposed on the printed circuit board and external electrical means. The surfaces of the aforementioned articles have metallic layers deposited by a method disclosed herein.

The present invention will be further understood from the illustration of specific examples which follow.

EXAMPLE 1

A 200 milliliter solution of Ni/Mo electroless bath was made by adding 0.015M sodium molybdate to a standard electroless AK1000® Ni/P bath, sold by Allied Kelite Corporation. The pH of the bath was adjusted to 9.0 by using NaOH. The bath was maintained at 85° C. during plating.

Three 1" by 1" substrates of chemical vapor deposited diamond films were first activated by placing them in a solution of MacDermid® D34C Pd for 4 minutes at 25° C., followed by washing in deionized water and then by drying in air.

The first diamond substrate was then placed in the plating bath. Plating time was 20 minutes. The Ni/Mo coat on the first diamond substrate was 2.0 micrometers thick. The substrate sample was gradually heated in a non-oxidizing atmosphere of 7% Hydrogen 93% Argon at a rate of 10° C./minute to 975° and then heat treated for 1 hour.

The adhesion was measured with a Sebastian Model I adhesion tester, sold by Quad Group, Santa Barbara, Calif. The adhesion tester measures the force in pounds per square inch (psi) required to pull a standardized epoxy coated pin off the test surface. The standardized epoxy coated pin is sold by Quad Group, Spokane, Wash. The epoxy surface of the pin was held against the test surface and then heated according to the standard test procedure to allow the epoxy to set to a standard adhesion level. The standard procedure specifies heating the pin with a test sample attached thereto for one hour at 150° C. The adhesion force required to separate the Ni/Mo coating from the pin was in excess of 3700 psi. At this force level, the pin separated from the epoxy side of the Ni/Mo layer which remained on the substrate side. The Ni/Mo layer on the first substrate, when examined under scanning electron microscopy, showed a smooth well wetted surface. The Ni/Mo coating was leached off the diamond substrate and analyzed by atomic absorption spectroscopy to determine its composition. The Ni/Mo coating was found to have a composition of 15.8% Mo, 83.4% Ni, 0.8% P.

For comparison, the third diamond substrate was nickel coated by AK1000® Ni/P bath without Mo or W added. This coating showed complete balling of the nickel from the diamond surface after the heat treatment and under the aforementioned adhesion test, this coating separated from the diamond surface of the third substrate at less than 100 psi.

EXAMPLE 2

A 200 milliliter solution of Ni/W electroless bath was made by adding 0.20M sodium tungstate to a standard electroless AK1000® Ni/P bath, sold by Allied Kelite Corporation. The pH of the bath was adjusted to 9.0 by using NaOH. The bath was maintained at 85° C. during plating. The second activated diamond substrate, activated by the steps described in Example 1, was then placed in the plating bath. Plating time was 5 minutes.

The Ni/W coat on the second diamond substrate was 3.0 micrometers thick. The substrate sample was gradually heated in a non-oxidizing atmosphere of 7% Hydrogen 93% Argon at a rate of 10° C./minute to 975° C. and then heat treated for 1 hour.

The adhesion was measured with the Sebastian Model I adhesion tester described in Example 1. The adhesion force required to separate the Ni/W coating from the pin was in excess of 1000 psi. The Ni/W coating showed some evidence of balling. The coating was leached off the diamond substrate and analyzed by atomic absorption spectroscopy to determine its composition. The Ni/W coating was found to have a composition of 3.8% W, 92.0% Ni, 4.2% P.

For comparison, the third diamond substrate was nickel coated by AK1000® Ni/P bath without Mo or W added. This coating showed complete balling of the nickel from the diamond surface after the heat treatment and under the aforementioned adhesion test, this coating separated from the diamond surface of the third substrate at less than 100 psi.

EXAMPLE 3

A 20 gram batch of diamond powder having 120/140 mesh size was suspended in MacDermid® D34C Pd catalyst for 4 minutes at 25° C., and then rinsed in deionized water and air dried. The diamond particles were placed in 1500 ml of the Ni/Mo bath described in example 1. The diamond powder was rinsed in deionized water after electroless plating by the Ni/Mo bath and then filtered and air dried. The electrolessly plated diamond powder was then heat treated for one hour in 7% Hydrogen 93% Argon. The heat was gradually increased at a steady rate of 10° C./minute to 975° C. The heat treated diamond powder was then examined under scanning electron microscopy. The examination showed diamond powder particles having a uniform well wetted coat. The Ni/Mo coating was stripped off the diamond powder in a conventional acid bath and then analyzed by atomic absorption spectroscopy for its composition. The Ni/Mo composition was identical to the one in Example 1. The thickness of Ni/Mo coat was calculated from the weight gain, assuming uniform coverage. It was determined to be 0.9 micrometers. The Ni/Mo coated diamond particles were then electrolessly plated with a second layer in AK1000® Ni/P bath for a time sufficient to obtain 56 weight % a nickel coat. This diamond powder was then used in an abrasive grinding wheel. The particles of the diamond powder showed good adhesion to the Ni/Mo bond coat and Ni/P overcoat.

What is claimed is:

1. A method of improving adhesion of a nickel alloy coat to a surface of a diamond article comprising the steps of:

contacting said article for an effective time with an electroless plating bath for plating said surface of said article to a desired thickness, said bath comprising a compound of nickel and a compound of a transitional metal selected from the group consisting of molybdenum, titanium, niobium and chromium;

gradually heating said electrolessly plated article in a non-oxidizing atmosphere from a first temperature to a desired heat treatment temperature at a predetermined rate; and maintaining said electrolessly plated article at said desired heat treatment until a desired degree of adhesion between said surface and said metal alloy coat is attained.

2. The method according to claim 1 wherein said nickel is alloyed with phosphorus.

3. The method according to claim 1 further comprising depositing an electrolessly applied or electrolytically applied second metal layer on top of said metal alloy coat.

4. The method according to claim 3 which further comprises providing said article with a second heat treatment at about 100° C. to about 500° C. for about 5 minutes to about 20 hours after deposition of said second metal layer.

5. The method according to claim 1 wherein said bath is maintained at a pH of about 8.5 to about 10.

6. The method according to claim 1 wherein the concentration of said compound of said molybdenum in said bath is about 0.001M to about 0.1M.

7. The method according to claim 1 wherein said first temperature is room temperature.

8. The method according to claim 1 wherein said desired heat treatment temperature is about 800° C. to about 1000° C.

9. The method according to claim 1 wherein said predetermined rate is about 10° C. per minute.

10. The method according to claim 1 wherein said diamond article is a grinding wheel which further comprises uniformly dispersed and embedded abrasive diamond particles having said metal coat thereon in a resinous matrix.

11. The method according to claim 1 wherein said diamond article is a substrate of a printed circuit board having said metal coat in the form of conductive tracks.

12. The method according to claim 1 wherein said diamond article is a substrate of a heat sink for electrical components, said substrate having said metal coat thereon.

13. A method of improving adhesion of a nickel alloy coat of a desired thickness to surfaces of diamond particles comprising the steps of:

contacting said particles for an effective time with an electroless plating bath, said bath further comprising a compound of said nickel and a compound of a transitional metal selected from the group consisting of molybdenum, titanium, niobium and chromium, for plating said surfaces of said particles with said nickel alloy coat;

gradually heating said electrolessly plated particles in a non-oxidizing atmosphere from a first temperature to a desired heat treatment temperature at a predetermined rate; and maintaining said electrolessly plated particles at said desired heat treatment temperature until a desired degree of adhesion between said surfaces and said nickel alloy coat is attained.

14. The method according to claim 13 wherein said bath is agitated during said plating of said surfaces to prevent bridging of said particles.

15. The method according to claim 13 wherein said bath contains molybdenum at a concentration of about 0.01M to about 0.02M.

16. The method according to claim 13 wherein said electrolessly plated particles are further provided with a second layer of electrolessly applied nickel phosphorus alloy.

* * * * *